US009273535B1

(12) United States Patent
George et al.

(10) Patent No.: US 9,273,535 B1
(45) Date of Patent: Mar. 1, 2016

(54) HYDRAULIC FLOW RESTRICTION TUBE TIME DELAY SYSTEM AND METHOD

(71) Applicant: GEODynamics, Inc., Millsap, TX (US)

(72) Inventors: Kevin R. George, Cleburne, TX (US); Philip Martin Snider, Tomball, TX (US); John T. Hardesty, Weatherford, TX (US); Michael D. Wroblicky, Weatherford, TX (US); James A. Rollins, Lipan, TX (US); Nathan G. Clark, Mansfield, TX (US); Jarrod Henry Pearson, Weatherford, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 14/685,176

(22) Filed: Apr. 13, 2015

Related U.S. Application Data

(60) Provisional application No. 62/081,196, filed on Nov. 18, 2014.

(51) Int. Cl.
*E21B 34/10* (2006.01)
*E21B 34/08* (2006.01)

(52) U.S. Cl.
CPC ..... *E21B 34/108* (2013.01)

(58) Field of Classification Search
CPC ..... E21B 34/108
See application file for complete search history.

(56) References Cited

U.S. PATENT DOCUMENTS

| | | | | | |
|---|---|---|---|---|---|
| 3,780,809 | A | * | 12/1973 | Ayers et al. | 166/374 |
| 4,083,409 | A | * | 4/1978 | Barrington | 166/320 |
| 4,113,012 | A | * | 9/1978 | Evans et al. | 166/264 |
| 4,691,779 | A | * | 9/1987 | McMahan et al. | 166/321 |
| 4,809,778 | A | * | 3/1989 | Johnson | 166/310 |
| 4,957,167 | A | * | 9/1990 | Schultz | 166/319 |
| 5,058,674 | A | * | 10/1991 | Schultz et al. | 166/264 |
| 5,103,906 | A | * | 4/1992 | Schultz et al. | 166/264 |
| 5,238,070 | A | * | 8/1993 | Schultz et al. | 166/386 |
| 5,887,654 | A | * | 3/1999 | Edwards et al. | 166/297 |
| 5,950,733 | A | * | 9/1999 | Patel | 166/373 |
| 8,474,535 | B2 | | 7/2013 | Richards et al. | |

(Continued)

OTHER PUBLICATIONS

ISA/US, International Search Report and Written Opinion for PCT/US2015/029982 dated Aug. 26, 2015.

(Continued)

*Primary Examiner* — Nicole Coy
(74) *Attorney, Agent, or Firm* — David W. Carstens; Sudhakar V. Allada; Carstens & Cahoon, LLP

(57) ABSTRACT

A hydraulic time delay system and method in a wellbore tool is disclosed. The system/method includes an actuation mechanism which allows pressure to act on a functional piston in the wellbore tool. The movement of the piston is restrained by a partially or filled reservoir which is allowed to exhaust through a flow restriction element. The restriction element comprises standard metal tubing with a known inner diameter and is cut to an exact length as predicted by fluid dynamic modeling. A time delay and rate of piston movement desired for the downhole tool, between a trigger event such as pressure and a functional event, can be tuned with parameters that include the length and diameter of the tubing, reservoir fluid viscosity and number of tubes in parallel. In another embodiment, a secondary plugging element added to the reservoir controls the rate of piston movement and time delay.

27 Claims, 7 Drawing Sheets

*FIG. 3* *FIG. 4* *FIG. 5*

(56) References Cited

U.S. PATENT DOCUMENTS

| | | | | |
|---|---|---|---|---|
| 8,807,215 | B2 | 8/2014 | Holderman et al. | |
| 2006/0096786 | A1 * | 5/2006 | Wells | 175/267 |
| 2014/0251620 | A1 | 9/2014 | George et al. | |
| 2014/0299330 | A1 | 10/2014 | Fripp et al. | |

OTHER PUBLICATIONS

The Lee Company, Technical Hydraulic Handbook, 11th Edition, 2009, pp. B0-B7, online catalog retrieved on Aug. 6, 2015 from http://www.theleeco.com/resources/pdf/THHcd09.pdf.

* cited by examiner

0400

HYDRAULIC FLOW RESTRICTION TUBE TIME DELAY SYSTEM AND METHOD

CROSS REFERENCE TO RELATED APPLICATIONS

This application claims priority to a provisional U.S. Patent Application No. 62/081,196 filed Nov. 18, 2014, the technical disclosure of which is hereby incorporated herein by reference.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to downhole wellbore tools. Specifically, the invention attempts to hydraulically control a rate of travel of a piston with standard hydraulic flow restriction tubing with a known inner diameter permitting a known time delay between a trigger event and a functional event.

PRIOR ART AND BACKGROUND OF THE INVENTION

1. Prior Art Background

In oil and gas extraction applications, there is a need to have a certain length of time delay between pressure triggered events such that the system can be tested at a pressure before the next event could proceed. This system cannot be controlled with any other means besides the application of pressure. Prior art system means of fluid restriction uses a complex system of microscopic passages that metered fluid. Therefore, there is a need for non-expensive simple and flexible component flow restriction systems.

The greatest limitation of current devices is that the sleeve or power piston of the device that allows fluid to flow from the casing to a formation (through openings or ports in the apparatus wall) opens immediately after the actuation pressure is reached. This limits the test time at pressure and in many situations precludes the operator from ever reaching the desired casing test pressure. Prior art overcomes that limitation by providing a hydraulic delay to afford adequate time to test the casing at the required pressure and duration before allowing fluid communication with the well bore and geologic formation. This is accomplished by slowly releasing a trapped volume of fluid through a hydraulic metering chamber that allows piston travel. However, there is a need to provide the time delay with commercially available tubes with a simple mechanism.

Prior Art System Hydraulic Time Delay System (0100) As generally seen in the system diagram of FIG. 1 (0100), prior art systems associated with hydraulic flow restriction include a flow restriction element (0101). Commercially available flow restriction elements such as the Visco Jet consists basically of three discs mounted one upon the other to form an extremely complex fluid passage. Fluid enters at the center of one disc and passes through a slot which is tangential to a spin chamber. This discharges through a small center hole into another chamber. This process repeats over and over. Since the spinning liquid makes many revolutions in each spin chamber, the resulting fluid resistance uses the flow passage surfaces many times. The tangential nature of the slots overcomes sensitivity to viscosity. The centrifugal force of the liquid maintains a back pressure on the discharge of the slot which is proportional to the square of the RPM of the spinning liquid.

The prior art as detailed above suffers from the following deficiencies:

- Prior art systems do not provide large pressure rating time delay flow restriction elements exceeding 5000 PSI.
- hydraulic/mechanical/energetic shock absorbable time delay element that can withstand shock expected in a downhole wellbore.
- Prior art systems do not provide for a cost effective hydraulic time delay solution that uses time delay elements connected in parallel for time delays exceeding few hours.
- Prior art systems do not provide for small inner diameter flow restriction elements without reducing the overall inner diameter of a wellbore casing.
- Prior art systems do not provide for controlling time delay in a downhole wellbore with secondary plugging agents in a fluid reservoir.

While some of the prior art may teach some solutions to several of these problems, the core issue of reacting to unsafe gun pressure has not been addressed by prior art.

OBJECTIVES OF THE INVENTION

Accordingly, the objectives of the present invention are (among others) to circumvent the deficiencies in the prior art and affect the following objectives:

- Provide for large pressure rating time delay flow restriction elements exceeding 5000 PSI.
- Provide for a low cost configurable time delay flow restriction element that could be commonly available.
- Provide for a hydraulic/mechanical/energetic shock absorbable time delay element that can withstand shock expected in a downhole wellbore.
- Provide for a cost effective hydraulic time delay solution that uses time delay elements connected in parallel for time delays exceeding few hours.
- Provide for small inner diameter flow restriction elements without reducing the overall inner diameter of a wellbore casing.
- Provide for controlling time delay in a downhole wellbore with secondary plugging agents in a fluid reservoir.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner. The system includes an actuation mechanism which allows pressure to act on a functional piston in the downhole tool. The movement of the piston is restrained by a partially or filled reservoir which is allowed to exhaust through a flow restriction element. The restriction element comprises standard metal tubing with a known inner diameter and is cut to an exact length as predicted by fluid dynamic modeling. A time delay and rate of piston movement desired for the downhole tool, between a trigger event such as pressure and a functional event, can be tuned with parameters that include the length and diameter of the tubing, reservoir fluid viscosity, and number of tubes in parallel. In another embodiment, a secondary plugging element added to the reservoir controls the rate of piston movement and time delay.

Method Overview

The present invention system may be utilized in the context of an overall downhole wellbore hydraulic time delay method, wherein the downhole wellbore hydraulic time delay system as previously described is controlled by a method having the following steps:

(1) positioning a wellbore tool at a desired wellbore location;
(2) checking if a differential pressure acted on a piston exceeds a rated pressure;
(3) motioning the piston from a first trigger position into a space of said reservoir; and
(4) retarding a rate of travel of the piston from the first trigger position to a second functional position.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
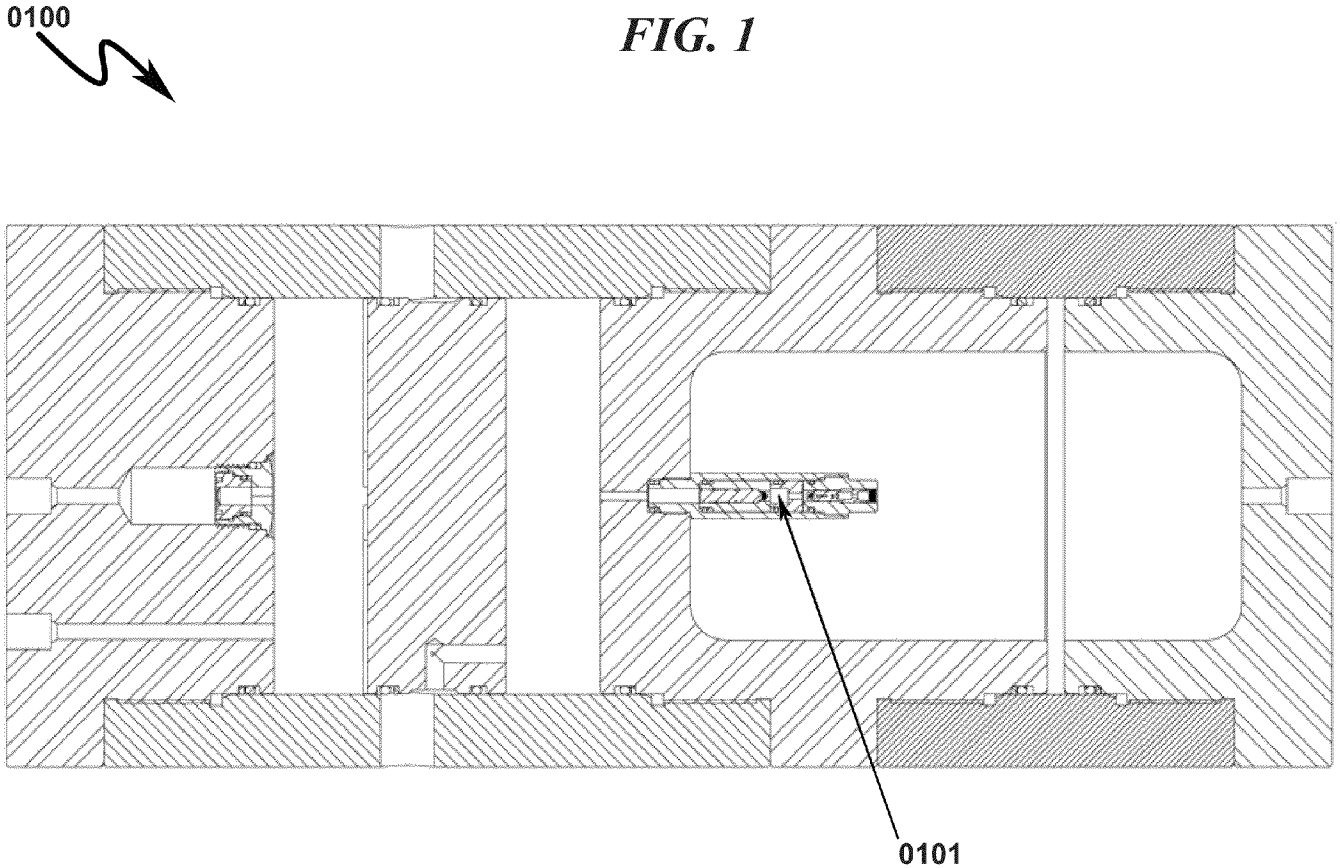
FIG. 1 Prior Art
FIG. 1 illustrates a system cross-section overview diagram describing how prior art systems use restriction flow elements for time delay purposes.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a hydraulic time delay system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Preferred Exemplary System Block Diagram Hydraulic Time Delay Flow Restriction Metal Tube (0200-0600)

Figures 2, 3, 4, 5:
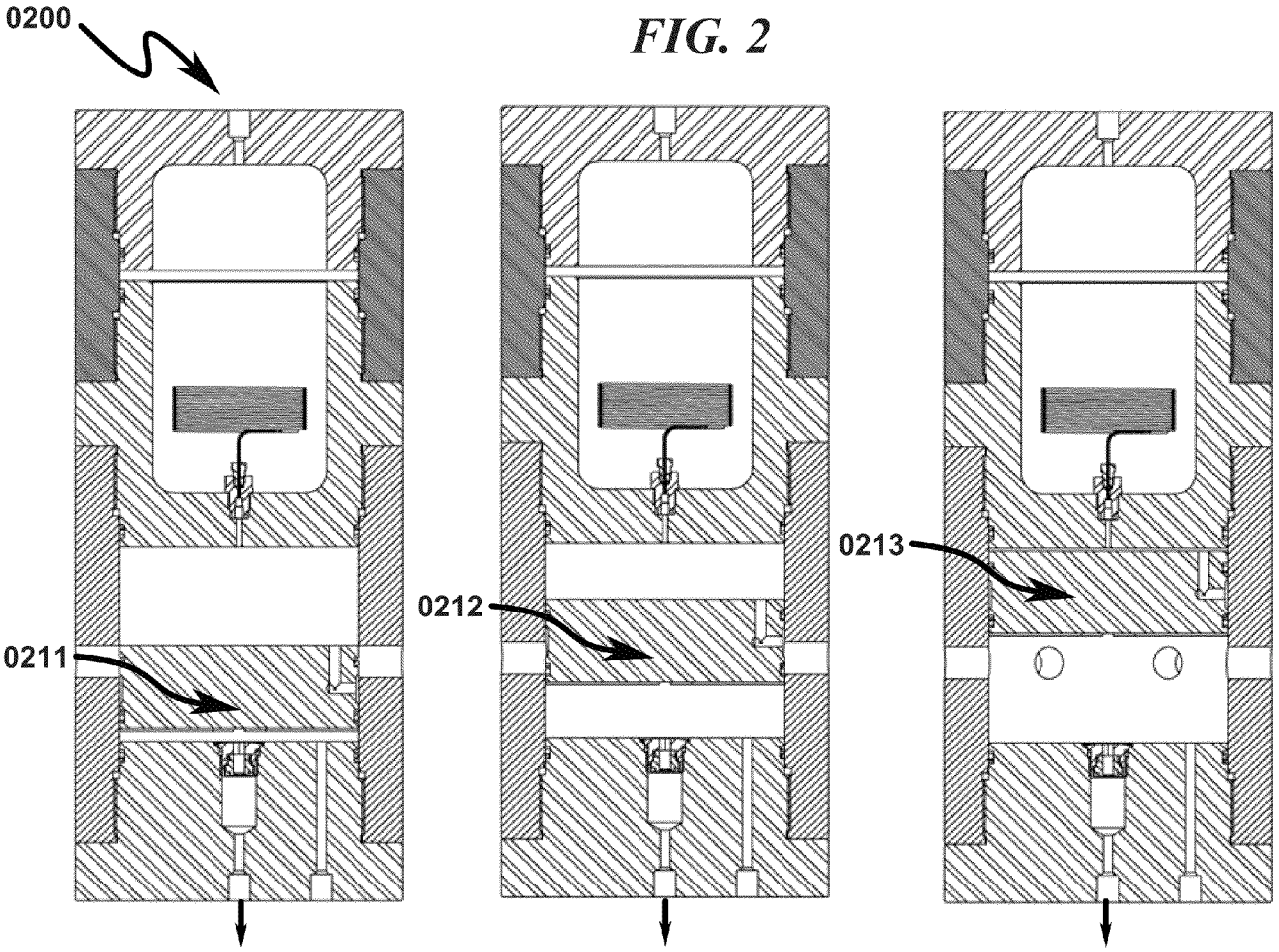
FIG. 2 illustrates a system cross-section overview diagram describing an initial set up, actuation position and a final functional position for a time delay hydraulic flow restriction tube according to a presently exemplary embodiment of the present invention.
FIG. 3 illustrates a system cross-section overview diagram describing an initial set-up for a time delay hydraulic flow restriction tube according to a presently exemplary embodiment of the present invention.
FIG. 4 illustrates a system cross-section overview diagram describing an actuation position for a time delay hydraulic flow restriction tube according to a presently exemplary embodiment of the present invention.
FIG. 5 illustrates a system cross-section overview diagram describing a completed actuation position for a time delay hydraulic flow restriction tube according to a presently exemplary embodiment of the present invention.
Figure 3:
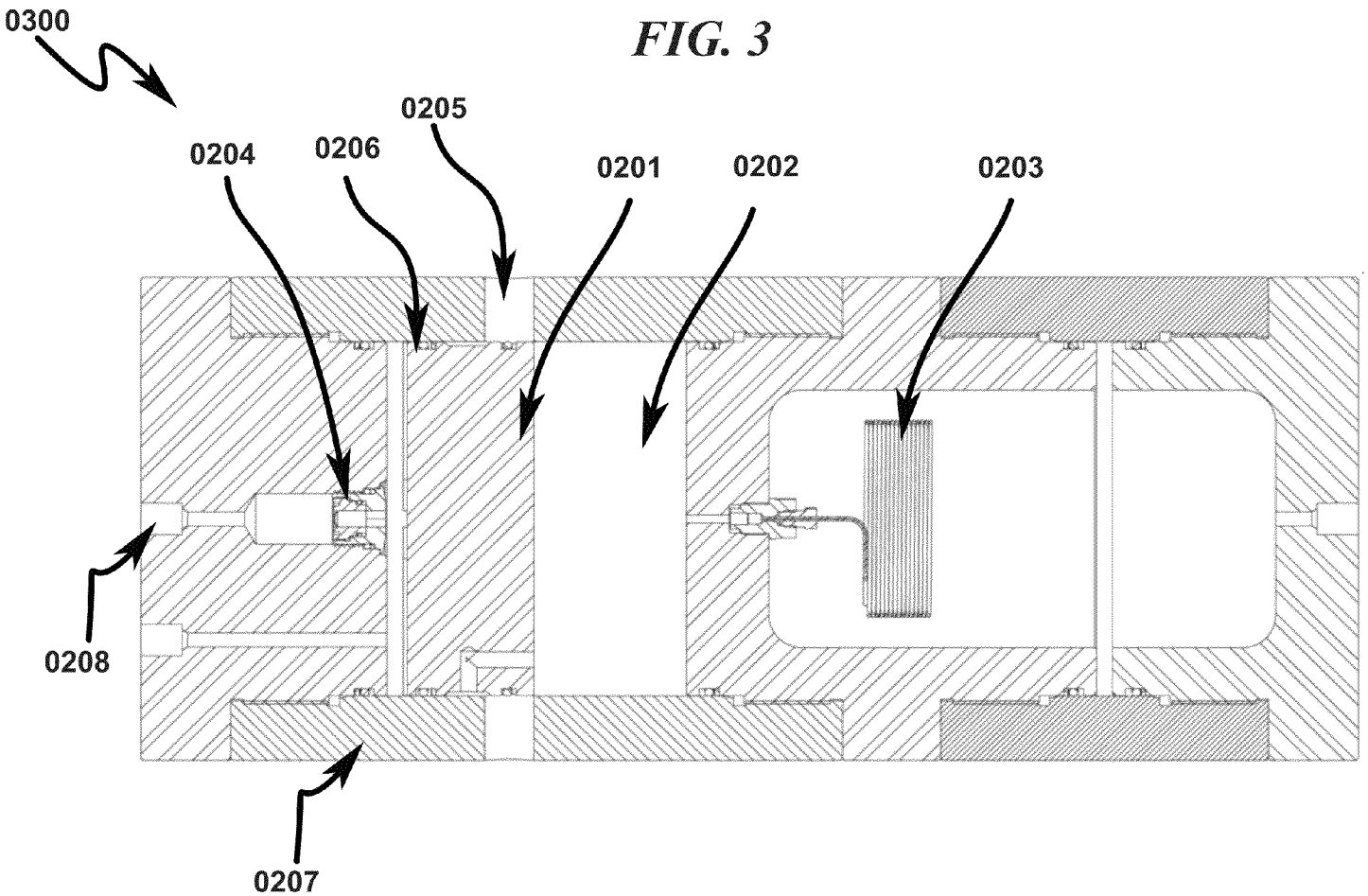
Figure 4:
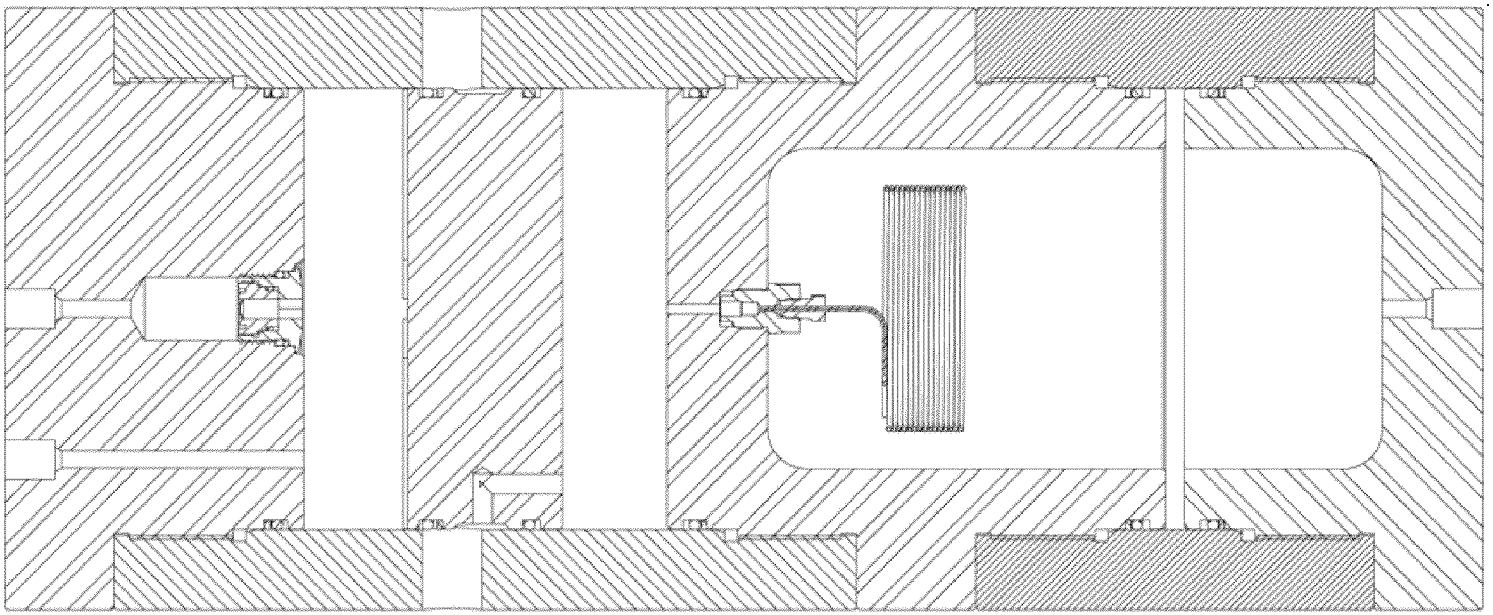
Figures 5, 6:
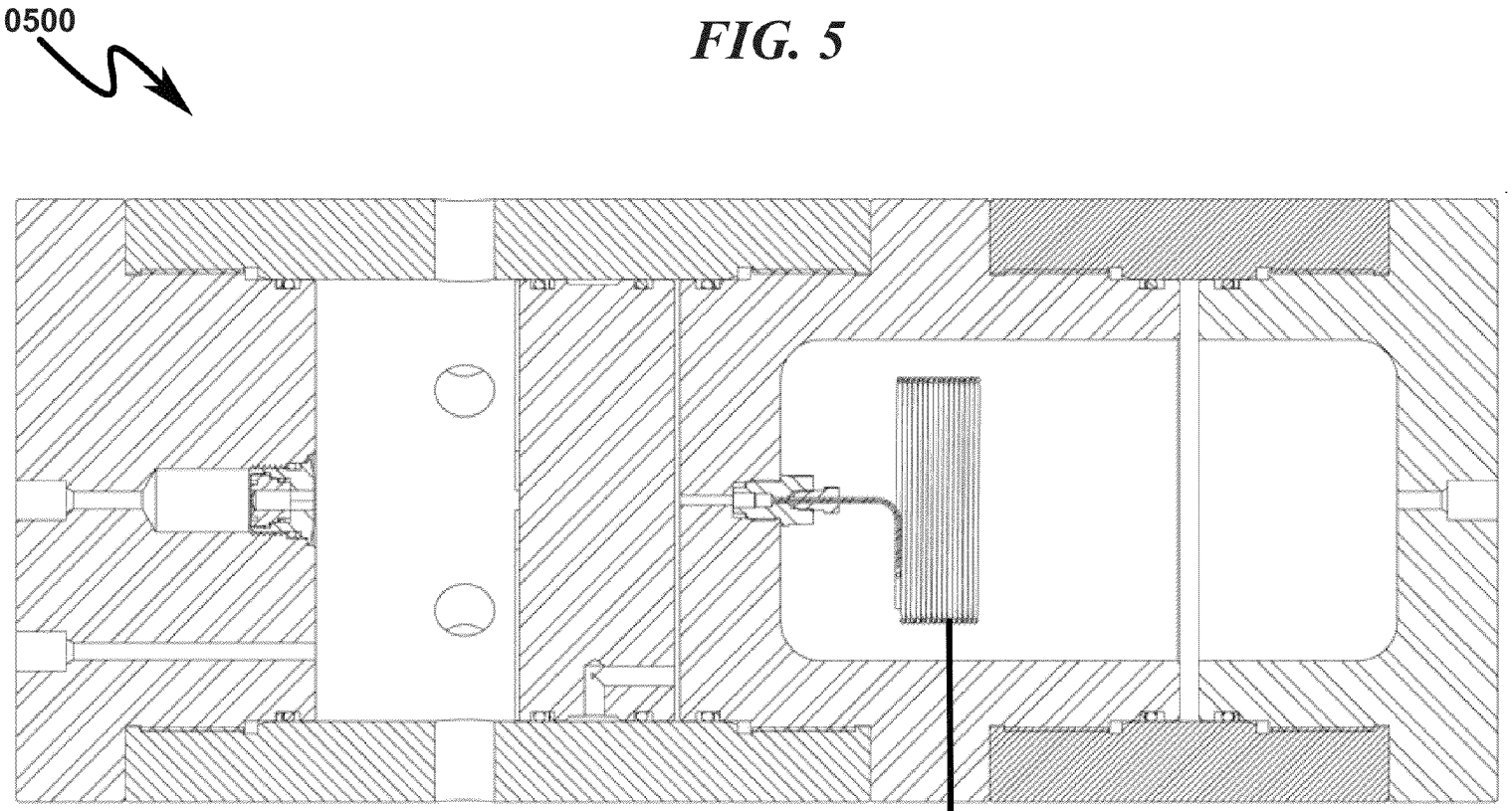
FIG. 6 illustrates an enlarged system cross-section overview diagram of a time delay hydraulic flow restriction tube according to a presently exemplary embodiment of the present invention.
Figure 6:
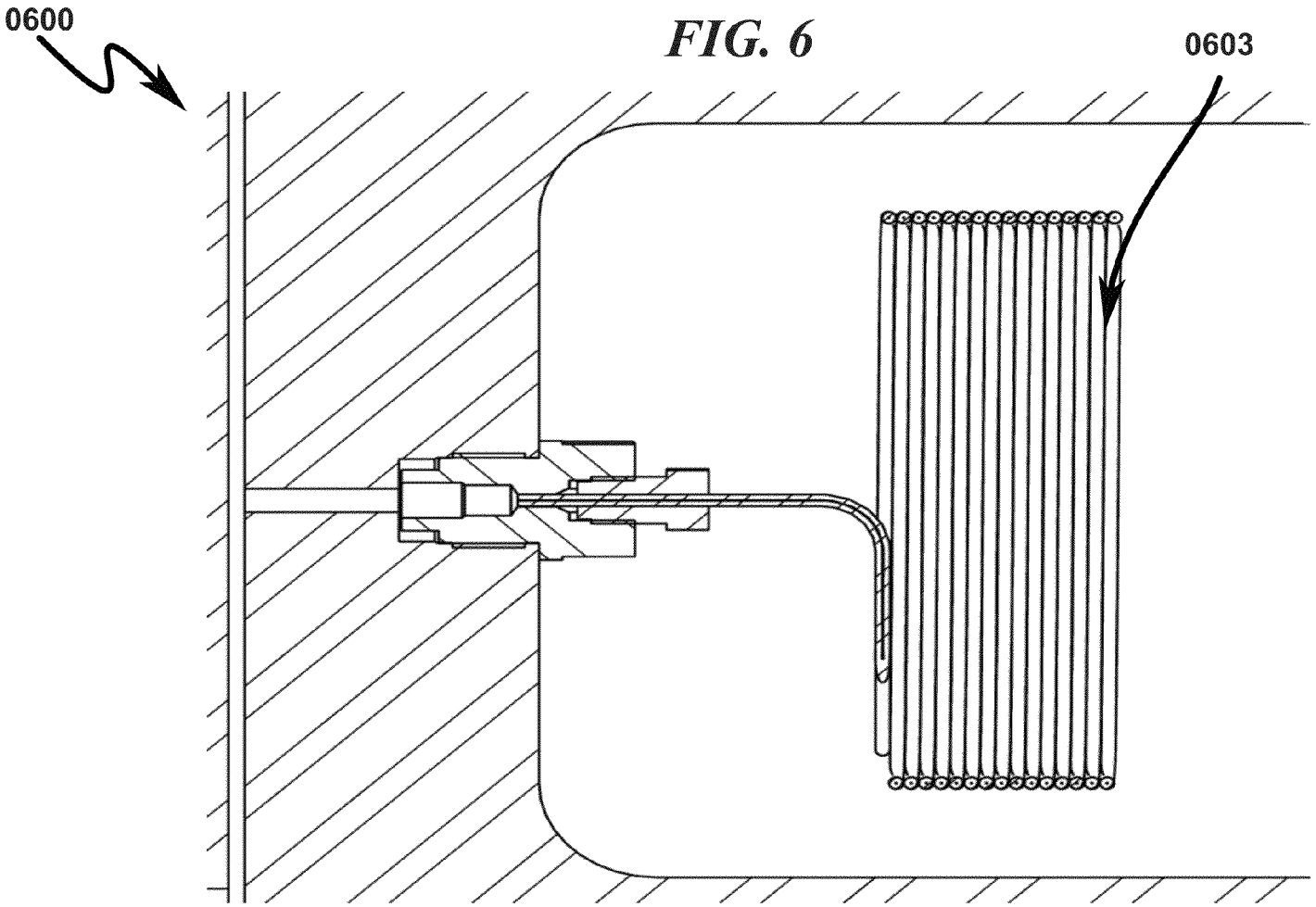

The present invention may be seen in more detail as generally illustrated in FIG. 2 (0200), FIG. 3 (0300), FIG. 4 (0400), FIG. 5 (0500), FIG. 6 (0600), wherein a downhole wellbore tool is deployed inside a wellbore casing. FIG. 2 generally illustrates different positions of a piston (0201) as it moves into an adjacent chamber (0202). The positions include an initial trigger position (0211), an intermediate position (0212) and a final functional position (0213). A detailed view of the tool in the initial trigger position is shown in FIG. 3 (0300), intermediate position is shown in FIG. 4 (0400) and a final functional position is shown in FIG. 5 (0500). The entire tool may be piped into the casing string as an integral part of the string and positioned where functioning of the tool is desired. In one exemplary embodiment, the tool may be a toe valve that is positioned where perforation of a formation and fluid injection into a formation is desired. The tool may be installed in either direction with no change in its function. A functioning piston (0201) that is adjacent to a fluid reservoir ("chamber") (0202) containing a fluid, is at an initial trigger position (0211). The piston (0201) is in fluid communication with the fluid reservoir (0203). The functioning piston (0201) may be sealed by seals such as elastomeric seals (0206). The piston (0201) is held at an initial trigger position (0211) by a pressure activated opening device (0204), such as a rupture disk. The tool mandrel (0207) is machined to accept the opening device (0204) (such as rupture discs) that ultimately controls actuation of the piston (0201). In one embodiment, the rated pressure of the opening device may range from 5000 PSI to 15000 PSI.

When ready to operate, the casing pressure is increased to a test pressure condition ("the trigger condition"). This increased pressure causes a pressure differential to exceed the rating pressure of a pressure opening device (0204) thereby, rupturing the opening device (0204) and fluid at casing pressure (hydrostatic, applied or any combination) enters a chamber immediately below and adjacent to the piston (0201). This entry of fluid causes the piston (0201) to begin moving from an initial trigger position (0211) into the space of fluid chamber (0202).

As fluid pressure further increases through port (0208) it moves piston (0201) into the fluid chamber (0202). The restrained movement of the piston allows a time delay from the time the pressure opening device (0204), is ruptured until the piston moves to a functional position (0213). Hydraulic fluid in the fluid chamber (0202) enters the hydraulic restrictor tube retarding a rate of travel of the piston.

According to a preferred exemplary embodiment, a hydraulic flow restriction tube (0203) allows fluid to pass from chamber (0202) to a lower pressure chamber. The flow restriction tube (0203) controls the rate of flow of fluid from chamber (0202) and thereby controls the rate of travel of the piston (0201) as it moves to a fully functional position (0213). It should be noted that the rate of travel of the piston directly affects a time delay between a trigger event and a functional event. The flow restriction tube material may be steel, stainless steel, brass, copper, metal, plastic, PEEK, or polymer. In addition, the flow restriction tube is chosen such that it is resistant to hydraulic, energetic, and mechanical shock from conditions expected in the wellbore.

In one exemplary embodiment, slots/ports (0205) in the wellbore tool act as passageways for fluid from the casing to the formation. FIG. 4 (0400) shows the position of piston during the tool actuation. The position of the piston (0212) is in between an initial trigger position (0211) and a final functional position (0213). Initially, this movement increases pressure in the fluid chamber to a value that closely reflects the hydrostatic plus applied casing pressure. There is considerable predetermined control over the delay time by learned manipulation of the fluid type, fluid volume, initial charging pressure of the low pressure chamber and the variable flow rate through the flow restriction tube (0203). A detailed view of the hydraulic flow restriction tube (0603) is generally illustrated in FIG. 6 (0600). The time delay can be set as desired but generally will be about 5 to 60 minutes.

In one preferred exemplary embodiment, the hydraulic flow restriction tube is a capillary tube. The capillary tube may have a small inner diameter, such that the capillary force generated by a fluid passing through it is a first order effect. The hydraulic flow restriction tube (0603) parameters and hydraulic fluid properties may be selected to achieve the desired time delay as described below.

Hydraulic Flow Restrictor Tube Time Delay Drivers:

Tube Length:

In one exemplary embodiment, the length of the hydraulic flow restrictor tube may be chosen so that a desired time delay is achieved. A longer tube lowers the flow rate of the fluid from the reservoir and thereby increases the time delay. Conversely, a shorter tube increases the flow rate of the fluid from the reservoir and thereby decreases the time delay. For example, a 10 minute time delay may be achieved with a 10 feet tube and a 30 minute time delay may be achieved with a 50 feet tube with all the other factors remaining the same.

Tube Diameter:

In another exemplary embodiment, the inner diameter of the hydraulic flow restrictor tube may be chosen so that a desired time delay is achieved. A smaller inner diameter tube lowers the flow rate of the fluid from the reservoir and thereby increases the time delay. Conversely, a larger inner diameter tube increases the flow rate of the fluid from the reservoir and thereby decreases the time delay. For example, a 30 minute time delay may be achieved with a 0.007 inches inner diameter and a 10 minute time delay may be achieved with a 0.01 inches inner diameter with all the other factors remaining the same.

Fluid Viscosity:

The fluid in the reservoir/chamber may be selected to achieve a desired time delay between a trigger event and a functional event. It is known that viscosity is inversely proportional to temperature. A higher viscosity fluid lowers the flow rate of the fluid from the reservoir and thereby increases the time delay. Conversely, lower viscosity fluid increases the flow rate of the fluid from the reservoir and thereby decreases the time delay. Any hydraulic fluid will be suitable if capable of withstanding the pressure and temperature conditions that exist in the wellbore. Those skilled in the art will easily be able to select suitable fluids such as Skydrol 500B-4™, water, or McDermott fluid.

Number of Tubes:

In one preferred exemplary embodiment, multiple hydraulic flow restrictor tubes may be connected in parallel to achieve shorter delays and increased reliability. For example, a single hydraulic flow restrictor tube may provide a 10 minute delay versus a 3 minute delay for 3 hydraulic flow restrictor tubes connected in parallel.

In a most preferred exemplary embodiment, a 10 minute time delay is attained with a hydraulic restriction metal tube having an inner diameter of 0.007 inches and a length of feet at a 10000 PSI pressure differential and a temperature 200° F. The fluid used in the preferred embodiment may be water or an anti-coagulating, anti-corrosive fluid such as McDermott fluid typically used in a downhole wellbore.

In an alternative most preferred exemplary embodiment, a 30 minute time delay is attained with a hydraulic restriction metal tube having an inner diameter of 0.01 inches and a length of 150 feet, at a 10000 PSI pressure differential and a temperature of 200° F.

Secondary Plugging Agent Exemplary Embodiment

In yet another preferred exemplary embodiment, a secondary plugging agent may be introduced into the fluid reservoir that plugs a hydraulic restriction metal tube but could be metered. The addition of a secondary agent further retards the rate of travel of the piston, thereby increasing the time delay between a functional event and a trigger event. Larger delays may be possible with a small fluid reservoir with the addition of the secondary plugging agent. For example, a time delay between one hour and 24 hours may be attained with a reservoir having a 1 liter capacity. In a preferred exemplary embodiment, a time delay between 0.01 seconds and 14 days is achieved. In a further preferred exemplary embodiment, a time delay between 2 days and 14 days is achieved. In a most preferred exemplary embodiment, a time delay between 1 hour and 48 hours is achieved. The secondary plugging agent may have particles with different sizes that are less than the inner diameter of the hydraulic restriction metal tube. A larger particle size may be used for a larger time delay. For example if the inner diameter of the tube is 0.007 inches, the particle size may range from 0.0001 inch to 0.010 inches. In a preferred exemplary embodiment the particle size is between 0.0001 inches to 0.01 inches. The particles in the secondary plugging agent may be solid, semi-solid, crystalline, or precipitate at the wellbore temperature. The particles may also be generated from a chemical reaction that causes precipitation at the wellbore temperature.

In a preferred exemplary embodiment, a downhole wellbore tool comprises the hydraulic restriction metal tube for offsetting time delay between a trigger event and a functional event. The downhole tool may be a wellbore setting tool or a perforation tool. The perforation tool may be used in a perforating gun firing head for delaying a perforating event. Similarly, the perforation tool may also be a used for delaying perforating time between perforating guns in a perforating gun string assembly.

In another preferred exemplary embodiment, a downhole wellbore valve comprises the hydraulic restriction metal tube for offsetting time delay between a trigger event and a functional event. The valve may be a downhole formation injection valve.

In yet another preferred exemplary embodiment, an openhole or a cemented hydraulic fracturing valve comprises the hydraulic restriction metal tube for offsetting time delay between a trigger event and a functional event. The time delay to open or close the valve to fracture and perforate may be configured with the restriction metal tube. In a further exemplary embodiment, the cemented hydraulic fracturing valve may be a toe valve that is opened to a hydrocarbon formation after a casing pressure is reached. In this case, the time after reaching the casing pressure (trigger event) and a fracturing (functional event) is delayed to provide sufficient time to check for casing integrity.

In a further preferred exemplary embodiment, the hydraulic flow restrictor tube allows for heat incorporation or dissipation as required by the overall tool. As the fluid passes through the system it is more thermally susceptible to the addition or subtraction of thermal energy.

Preferred Exemplary Embodiment Hydraulic Flow Restriction Tube in Conjunction with a Flow Restriction Element In a further preferred exemplary embodiment, the hydraulic flow restrictor tube may be mechanically connected in series or parallel to a commercially available flow restriction element such as a ViscoJet. The addition of the hydraulic flow restrictor tube provides more delay and reduces mechanical/energetic shock to the flow restriction element.

Preferred Exemplary Flowchart Embodiment of a Time Delay Hydraulic Flow Restriction Tube (0700)

Figure 7:
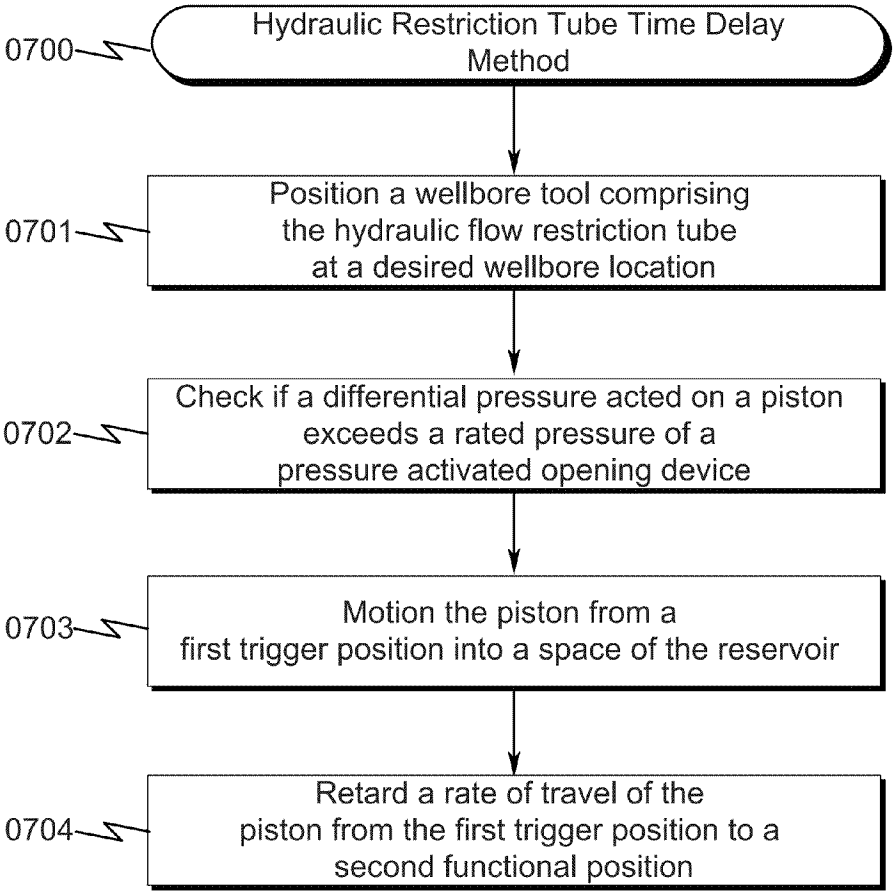
FIG. 7 illustrates an exemplary flow chart for retarding the rate of travel of a functional piston with a hydraulic flow restriction tube deployed in a downhole wellbore according to a presently exemplary embodiment of the present invention.

As generally seen in the flow chart of FIG. 7 (0700), a preferred exemplary flowchart embodiment of a time delay hydraulic flow restriction tube method may be generally described in terms of the following steps:

(1) positioning a wellbore tool comprising the hydraulic flow restriction tube at a desired wellbore location (0701);

The entire tool may be piped into the casing string as an integral part of the string and positioned where functioning of the tool is desired or the tool may be deployed to the desired location using TCP or a wire line. The wellbore may be cemented or not.

(2) checking if a differential pressure acted on a piston exceeds a rated pressure (0702);

If the differential pressure acting on the piston is greater than a rated pressure of a pressure activated opening device, the device ruptures and allows the piston to move. The rating of the pressure activated device could range from 5000 PSI to 15000 PSI.

(3) motioning the piston from a first trigger position into a space of the reservoir (0703); and (4) retarding a rate of travel of the piston from the first trigger position to a second functional position (0704).

System Summary

The present invention system anticipates a wide variety of variations in the basic theme of hydraulic time delay, but can be generalized as hydraulic flow restriction tube system comprising:

(a) a piston;

(b) a reservoir for containing a hydraulic fluid, the reservoir adjacent to the piston; and (c) a flow restriction tube in fluid communication with the reservoir;

whereby, when in use, when a pressure differential acting on the piston exceeds a rated pressure, the piston is urged into space of the reservoir, the hydraulic fluid flows into the flow restriction tube to retard rate of travel of the piston.

This general system summary may be augmented by the various elements described herein to produce a wide variety of invention embodiments consistent with this overall design description.

Method Summary

The present invention method anticipates a wide variety of variations in the basic theme of implementation, but can be generalized as a hydraulic flow restriction tube method wherein the method is performed on hydraulic flow restriction tube comprising:

(a) a piston;

(b) a reservoir for containing a hydraulic fluid, the reservoir adjacent to the piston; and (c) a flow restriction tube in fluid communication with the reservoir;

whereby, when in use, when a pressure differential acting on the piston exceeds a rated pressure, the piston is urged into space of the reservoir, the hydraulic fluid flows into the flow restriction tube to retard rate of travel of the piston;

wherein the method comprises the steps of:

(1) positioning a wellbore tool at a desired wellbore location;

(2) checking if a differential pressure acted on a piston exceeds a rated pressure;

(3) motioning the piston from a first trigger position into a space of said reservoir; and (4) retarding a rate of travel of the piston from the first trigger position to a second functional position.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the flow restriction tube comprises plural tubes connected in parallel.

An embodiment wherein the flow restriction tube material is selected from a group comprising: steel, stainless steel, brass, copper, glass, plastic, polymer, or PEEK.

An embodiment wherein the piston starts movement to a second functional position when the pressure differential exceeds the rated pressure of a pressure opening device; the pressure opening device mechanically coupled to the piston.

An embodiment wherein the piston is at a first trigger position when the pressure differential is less than the rated pressure of a pressure opening device; the pressure opening device mechanically coupled to the piston.

An embodiment wherein the flow restriction tube is a capillary tube.

An embodiment wherein the flow restriction tube is resistant to hydraulic shock expected in said wellbore.

An embodiment wherein said flow restriction tube is resistant to mechanical shock expected in said wellbore.

An embodiment wherein said flow restriction tube is resistant to energetic shock expected in the wellbore.

An embodiment wherein the flow restriction tube inner diameter ranges from 0.001 inches to 0.03 inches.

An embodiment wherein the flow restriction tube length is at least 10 inches.

An embodiment wherein the flow restriction tube inner diameter at least in part determines the rate of travel.

An embodiment wherein the flow restriction tube length at least in part determines the rate of travel.

An embodiment wherein a number of the metal tubes attached in parallel at least in part determine the rate of travel.

An embodiment wherein the reservoir fluid viscosity at least in part determines the rate of travel.

An embodiment wherein the flow restriction tube is further coupled to a restriction element; the restriction element configured to add further retard the rate of travel.

An embodiment wherein a secondary plugging agent is added to reservoir fluid to further retard the rate of travel.

An embodiment wherein the secondary plugging agent comprises fluid particles; the particle size is configured to control the rate of travel of the piston.

An embodiment wherein said particle size is between 0.0001 inches and 0.01 inches.

An embodiment wherein said delay ranges from 0.01 seconds to 1 hour.

An embodiment wherein said delay ranges from 1 hour to 48 hours.

An embodiment wherein said delay ranges from 2 days to 14 days.

An embodiment wherein said delay ranges from 0.01 seconds to 14 days.

An embodiment wherein said pressure differential is at least 5000 PSI.

One skilled in the art will recognize that other embodiments are possible based on combinations of elements taught within the above invention description.

CONCLUSION

A hydraulic time delay system and method in a wellbore tool has been disclosed. The system/method includes an actuation mechanism which allows pressure to act on a functional piston in the wellbore tool. The movement of the piston is restrained by a partially or filled reservoir which is allowed to exhaust through a flow restriction element. The restriction element comprises standard metal tubing with a known inner diameter and is cut to an exact length as predicted by fluid dynamic modeling. A time delay and rate of piston movement desired for the downhole tool, between a trigger event such as pressure and a functional event, can be tuned with parameters that include the length and diameter of the tubing, reservoir fluid viscosity and number of tubes in parallel. In another embodiment, a secondary plugging element added to the reservoir controls the rate of piston movement and time delay.

What is claimed is:

1. A downhole wellbore tool, comprising a hydraulic time delay system conveyed on a wellbore casing, said system comprising:

(a) a piston;

(b) a reservoir for containing a hydraulic fluid, said reservoir adjacent to said piston;

(c) a capillary tube in fluid communication with said reservoir; and (d) a flow restriction element mechanically coupled to said capillary tube;

whereby, when in use, when a pressure differential acting on said piston exceeds a rated pressure, said piston is urged into space of said reservoir, said hydraulic fluid flows into said capillary tube and said flow restriction element to retard rate of travel of said piston.

2. A hydraulic time delay system of claim 1 wherein said capillary tube comprises plural tubes connected in parallel.

3. A hydraulic time delay system of claim 1 wherein said capillary tube material is selected from a group comprising: steel, stainless steel, brass, copper, glass, plastic, polymer, or PEEK.

4. A hydraulic time delay system of claim 1 wherein said piston starts movement to a second functional position when said pressure differential exceeds said rated pressure of a pressure opening device; said pressure opening device mechanically coupled to said piston.

5. A hydraulic time delay system of claim 1 wherein said piston is at a first trigger position when said pressure differential is less than said rated pressure of a pressure opening device; said pressure opening device mechanically coupled to said piston.

6. A hydraulic time delay system of claim 1 wherein said capillary tube is resistant to hydraulic shock expected in said wellbore.

7. A hydraulic time delay system of claim 1 wherein said capillary tube is resistant to mechanical shock expected in said wellbore.

8. A hydraulic time delay system of claim 1 wherein said capillary tube is resistant to energetic shock expected in said wellbore.

9. A hydraulic time delay system of claim 1 wherein said capillary tube inner diameter ranges from 0.001 inches to 0.03 inches.

10. A hydraulic time delay system of claim 1 wherein said capillary tube length is at least 10 inches.

11. A hydraulic time delay system of claim 1 wherein said capillary tube inner diameter at least in part determines said rate of travel.

12. A hydraulic time delay system of claim 1 wherein said capillary tube length at least in part determines said rate of travel.

13. A hydraulic time delay system of claim 1 wherein a number of said metal tubes attached in parallel at least in part determines said rate of travel.

14. A hydraulic time delay system of claim 1 wherein said reservoir fluid viscosity at least in part determines said rate of travel.

15. A hydraulic time delay system of claim 1 said flow restriction element is configured to add further retard said rate of travel.

16. A hydraulic time delay system of claim 1 wherein a secondary plugging agent is added to reservoir fluid to further retard said rate of travel.

17. A hydraulic time delay system of claim 16 wherein said secondary plugging agent comprises fluid particles; said particle size is configured to control said rate of travel of said piston.

18. A hydraulic time delay system of claim 16 wherein said secondary plugging agent precipitates at wellbore temperature.

19. A hydraulic time delay system of claim 17 wherein said particle size is between 0.0001 inches and 0.01 inches.

20. A hydraulic time delay system of claim 1 wherein said delay ranges from 0.01 seconds to 1 hour.

21. A hydraulic time delay system of claim 1 wherein said delay ranges from 1 hour to 48 hours.

22. A hydraulic time delay system of claim 1 wherein said delay ranges from 2 days to 14 days.

23. A hydraulic time delay system of claim 1 wherein said delay ranges from 0.01 seconds to 14 days.

24. A hydraulic time delay system of claim 1 wherein said pressure differential is at least 5000 PSI.

25. A hydraulic time delay method, said method operating in conjunction with a hydraulic time delay system conveyed on a wellbore casing, said system comprising:

(a) a piston;

(b) a reservoir for containing a hydraulic fluid, said reservoir adjacent to said piston; and (c) a capillary tube in fluid communication with said reservoir; and (d) a flow restriction element mechanically coupled to said capillary tube;

whereby, when in use, when a pressure differential acting on said piston exceeds a rated pressure, said piston is urged into space of said reservoir, said hydraulic fluid flows into said capillary tube and said flow restriction element to retard rate of travel of said piston;

wherein said method comprises the steps of:

(1) positioning said wellbore tool at desired wellbore location;

(2) checking if said differential pressure acted on said piston exceeds said rated pressure;

(3) motioning said piston from a first trigger position into said space of said reservoir, and (4) retarding said rate of travel of said piston from said first trigger position to a second functional position.

26. A downhole wellbore tool, comprising a hydraulic time delay system, said system comprising:

(a) a piston;

(b) a reservoir for containing a hydraulic fluid, said reservoir adjacent to said piston;

(c) said hydraulic fluid comprising secondary plugging agents; and (d) a capillary tube in fluid communication with said reservoir, whereby, when in use, when a pressure differential acting on said piston exceeds a rated pressure, said piston is urged into space of said reservoir, said hydraulic fluid along with said plugging agents flows into said capillary tube to retard rate of travel of said piston.

27. A downhole wellbore tool, comprising a hydraulic time delay system, said system comprising:

(a) a piston;

(b) a reservoir for containing a hydraulic fluid, said reservoir adjacent to said piston;

(c) a capillary tube comprising a plurality of tubes connected in parallel;

(d) said capillary tube in fluid communication with said reservoir, whereby, when in use, when a pressure differential acting on said piston exceeds a rated pressure, said piston is urged into space of said reservoir, said hydraulic fluid flows through said plurality of tubes in said capillary tube to retard rate of travel of said piston.

* * * * *